US007278618B2

(12) United States Patent
Tusting et al.

(10) Patent No.: US 7,278,618 B2
(45) Date of Patent: Oct. 9, 2007

(54) ACTIVE CAMMING DEVICE

(75) Inventors: Paul Tusting, Salt Lake City, UT (US); Bill Belcourt, Salt Lake City, UT (US); Joe Skrivan, Draper, UT (US); Dave Mellon, Park City, UT (US); Mark Santurbane, Salt Lake City, UT (US); David Narajowski, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 230 days.

(21) Appl. No.: 11/021,007

(22) Filed: Dec. 22, 2004

(65) Prior Publication Data

US 2005/0161567 A1 Jul. 28, 2005

Related U.S. Application Data

(60) Provisional application No. 60/538,413, filed on Jan. 22, 2004.

(51) Int. Cl.
*A47F 5/08* (2006.01)

(52) U.S. Cl. ..... 248/231.9; 248/925; 248/231.91; 248/694; 294/94; 294/95; 294/96; 294/28; 294/106; 294/19.1; 294/100

(58) Field of Classification Search ..... 248/925, 248/231.9, 231.91, 694; 294/94, 95, 96, 294/28, 106, 19.1, 100
See application file for complete search history.

(56) References Cited

U.S. PATENT DOCUMENTS 2,979,297 A 4/1961 Suozzo
3,877,679 A 4/1975 Lowe ..... 254/135
4,184,657 A 1/1980 Jardine ..... 248/1
4,513,641 A * 4/1985 Murray et al. ..... 81/486
4,565,342 A * 1/1986 Grow ..... 248/231.9
4,572,464 A 2/1986 Phillips ..... 248/1
4,575,032 A 3/1986 Taylor ..... 248/1
4,643,377 A * 2/1987 Christianson ..... 248/231.9

(Continued)

FOREIGN PATENT DOCUMENTS

GB 2369068 5/2002

(Continued)

*Primary Examiner*—Carl D. Friedman
*Assistant Examiner*—Nkeisha J. Dumas
(74) *Attorney, Agent, or Firm*—Trent H. Baker; Baker & Associates PLLC

(57) ABSTRACT

The present invention relates to a dual stem active camming device including a plurality of compression springs independently coupled to a plurality of cam lobes. The compression springs are positioned between the trigger and the clip-in point of the cam to protect the springs from damage and allow the trigger to compress the springs upon retraction. A flexible stem tube is positioned over the portion of the dual stem between the trigger and the cable terminals. The flexible stem tube shields the trigger wires from debris and abrasion. A rigid yoke is also positioned over the dual stem between the stem tube and cable terminals. The rigid yoke prevents uneven lateral bending on the head of the camming device that may otherwise cause the device to pull out of a placement. The cable terminals are positioned between the outer cam lobes and on either side of the inner cam lobe.

59 Claims, 7 Drawing Sheets

U.S. PATENT DOCUMENTS

| | | | | |
|---|---|---|---|---|
| 4,643,378 | A | 2/1987 | Guthrie et al. | 248/1 |
| 4,645,149 | A * | 2/1987 | Lowe | 248/231.9 |
| 4,781,346 | A * | 11/1988 | Banner | 248/231.9 |
| 4,832,239 | A | 5/1989 | Andersson | 223/95 |
| 4,834,327 | A * | 5/1989 | Byrne | 248/231.9 |
| 4,923,160 | A | 5/1990 | Waggoner | 248/200 |
| 6,042,069 | A * | 3/2000 | Christianson | 248/231.9 |
| 6,092,773 | A * | 7/2000 | Kieliszewski | 248/231.9 |
| 6,283,426 | B1 * | 9/2001 | Guthrie et al. | 248/231.9 |
| 6,679,466 | B2 * | 1/2004 | Brown | 248/231.9 |
| 6,736,359 | B2 * | 5/2004 | Murray | 248/231.9 |
| 7,014,156 | B2 * | 3/2006 | Apezetxea et al. | 248/231.9 |
| 7,040,588 | B2 * | 5/2006 | Lowe | 248/231.9 |
| 2002/0162927 | A1 * | 11/2002 | Brown | 248/231.9 |
| 2003/0057337 | A1 * | 3/2003 | Brown | 248/231.9 |
| 2004/0035992 | A1 * | 2/2004 | Watts | 248/231.9 |
| 2005/0098696 | A1 * | 5/2005 | Lowe | 248/231.9 |

FOREIGN PATENT DOCUMENTS

| | | |
|---|---|---|
| GB | 2380949 | 4/2003 |

* cited by examiner

ACTIVE CAMMING DEVICE

RELATED APPLICATIONS

This application claims priority to U.S. Provisional Application Ser. No. 60/538,413 filed Jan. 22, 2004, entitled "ACTIVE CAMMING DEVICE".

TECHNICAL FIELD

The present invention relates to active protection devices and more particularly to camming devices.

BACKGROUND

Climbers generally use clean protection devices for two distinct purposes. First, a clean protection device may be used as a form of safety protection for protecting a climber in the event of a fall and second, a clean protection device may intentionally be used to artificially support a climber's weight. Clean protection devices cam or wedge into a crack, hole, gap, orifice, taper, or recess in order to support an outward force. The area or surface within which the clean protection device supports the outward force is considered the protection surface. The protection surface can consist of natural materials such as rock or may consist of artificial materials such as concrete.

Clean protection devices are generally divided into active and passive categories. Passive protection devices include a single object, which contacts the protection surface to support an outward force. For example, a wedge is a passive protection device because it has a single head with a fixed shape. There are numerous types of passive protection devices including nuts, hexes, tri-cams, wedges, rocks, and chocks. Active protection devices include at least two movable objects that can move relative to one another to create a variety of shapes. For example, a slidable chock or slider nut is considered an active protection device because it includes two wedges that move relative to one another to wedge into various shaped crevices. When the two wedges of the slider nut are positioned adjacent to one another, the overall width of the protection device is significantly larger than if the two wedges are positioned on top of one another. The two wedges must make contact with the protection surface in order to actively wedge the device within the protection surface. A further subset of active protection devices is camming devices. These devices translate rotational displacement into linear displacement. Therefore, a slider chock would not be an active camming device because the two wedges simply slide relative to one another and do not rotate. Camming devices include two, three, and four cam lobe devices. The cam lobes on an active camming device are generally spring biased into an expanded position and are able to rotate or pivot about an axle to retract. In operation, at least one cam lobe on either side of the unit must make contact with the protection surface for the device to be able to actively support an outward force. Some active protection devices can also be used passively to support outward forces as well.

Active protection devices are generally preferable to passive protection devices because of their ability to cam into a variety of features. For example, a standard four-cam unit has a particular camming range that allows it to cam into features within a particular size range. The two most common connection systems used in three and four cam units are single stem and double stem systems. Double stem systems include a U-shaped cable that attaches independently to two cable terminals on either end of the head of the protection device. The clip-in point of a double stem system is simply the bottom of the U-shaped cable. Single stem systems include a single cable that is attached to a single cable terminal located at the center of the head of the protection device. The single stem system generally includes some form of clip-in loop attached to the single cable. Single stem connection systems are generally preferable for larger cams because they are less likely to obstruct particular camming placements.

Small camming devices provide protection and/or support from a small protection surface. For most applications, small camming devices must support the same outward forces as larger camming devices. Therefore, in order to provide reliable protection, small camming devices should maximize the camming surface, which contacts the protection surface. This objective becomes more difficult the smaller the protection surface within which the device is designed to accommodate. For example, a camming device that is designed to fit into cracks between 0.1 and 0.2 inches should maximize the camming surfaces of the camming device more so than a camming device that is designed to fit into cracks between 1 and 2 inches. In addition, small camming devices are more likely to pop out of the protection surface from axle bending, inverted cam lobes, or uneven lateral stem bending. Therefore, small camming devices should minimize these affects to ensure reliable placements.

SUMMARY

The present invention relates to an improved active camming device. In accordance with the present invention, a dual stem active camming device includes a plurality of compression springs independently coupled to the plurality of cam lobes. The compression springs are positioned between the trigger and the clip-in point of the cam to protect the springs from damage and allow the trigger to compress the springs upon retraction. In addition, a flexible stem tube is positioned over the portion of the dual stem between the trigger and the cable terminals. The flexible stem tube shields the trigger wires from debris and abrasion. A rigid yoke is also positioned over the dual stem between the stem tube and the cable terminals. The rigid yoke prevents uneven lateral bending on the head of the camming device that may otherwise cause the device to pull out of a placement. The cable terminals are positioned between the outer cam lobes and on either side of the inner cam lobe. Alternatively, a combination of compression springs and other springs could be used to actuate the cam lobes and remain consistent with the present invention. Likewise, any number of cam lobes may be used and remain consistent with the teachings of the present invention.

In one embodiment, the present invention includes a dual stem active camming device with three cam lobes. Two cable terminals are positioned between the outer two cam lobes and on either side of the middle cam lobe. The device includes a lower yoke, the inclusion of which results in requiring an increased force on the device before it will laterally bend in an undesired manner. The device also includes a flexible stem tube with at least one compliant spring. The stem tube shields the trigger wires that couple the three cam lobes to the springs and trigger. Three compression springs are positioned between the trigger and the clip-in-point on the device. The compression springs are independently coupled to the cam lobes. The compression springs are significantly protected from debris and interference by positioning them adjacent to the clip-in point. The compression springs bias the cam lobes in an open position. As the trigger is retracted, the pushers, independently coupled to the cam lobes via trigger wires, abut the compression springs allowing the cam lobes to be temporarily retracted.

In an alternative embodiment, the device includes two cam lobes positioned between the cable terminals. Two cam lobes devices are useful for fitting into small crevices that may not otherwise accommodate the width of a three or four cam lobe device. In the two cam lobe embodiment, only two springs are necessary for independent operation. Each of the cam lobes is coupled to one of the springs via one or more trigger wires. This alternative embodiment also includes a lower yoke, the inclusion of which results in requiring an increased force on the device before it will laterally bend in an undesired manner. The device includes a flexible stem tube with at least one compliant spring. The stem tube shields the trigger wires that couple the cam lobes to the springs and trigger. The two compression springs are positioned between the trigger and the clip-in-point on the device. The positioning of the compression springs adjacent to the clip-in point protects them from interference and debris. The compression springs bias the cam lobes in an open position. As the trigger is retracted, the pushers, independently coupled to the cam lobes via trigger wires, abut the compression springs allowing the cam lobes to be temporarily retracted.

In yet another alternative embodiment, the device includes four cam lobes. The cable terminals are positioned between the outer cam lobes and on either side of the two inner cam lobes. Four cam lobe devices provide additional stability in flaring or irregular shaped crevices because they provide additional connection points between the device and the camming surface. In this alternative embodiment, four springs are necessary to independently control the four cam lobes. However, coupling two or more cam lobes to the same spring would result in the use of fewer springs. For independent operation, each of the cam lobes is coupled to one of the springs via a trigger wire. This alternative embodiment also includes a lower yoke, the inclusion of which results in requiring an increased force on the device before it will laterally bend in an undesired manner. The device includes a flexible stem tube with at least one compliant spring. The stem tube shields the trigger wires that couple the four cam lobes to the springs and trigger. The four compression springs are positioned between the trigger and the clip-in-point on the device. The positioning of the compression springs adjacent to the clip-in point protects them from interference and debris. The compression springs bias the cam lobes in an open position. As the trigger is retracted, the pushers, independently coupled to the cam lobes via trigger wires, abut the compression springs allowing the cam lobes to be temporarily retracted.

The embodiments described above may also be combined. The foregoing and other features, utilities, and advantages of the invention will be apparent from the following detailed description of the invention with reference to the accompanying drawings.

BRIEF DESCRIPTION OF THE DRAWINGS

The accompanying drawings illustrate various embodiments of the present invention and are a part of the specification. The illustrated embodiments are merely examples of the present invention and do not limit the scope of the invention.

Throughout the drawings, identical reference numbers designate similar, but not necessarily identical, elements.

DETAILED DESCRIPTION

Reference will now be made to the drawings to describe presently preferred embodiments of the invention. It is to be understood that the drawings are diagrammatic and schematic representations of the presently preferred embodiments, and are not limiting of the present invention, nor are they necessarily drawn to scale.

The present invention relates to an improved active camming device. In accordance with the present invention, a dual stem active camming device includes a plurality of compression springs independently coupled to the plurality of cam lobes. The compression springs are positioned between the trigger and the clip-in point of the cam to protect the springs from damage and allow the trigger to compress the springs upon retraction. In addition, a flexible stem tube is positioned over the portion of the dual stem between the trigger and the cable terminals. The flexible stem tube shields the trigger wires from debris and abrasion. A rigid yoke is also positioned over the dual stem between the stem tube and the cable terminals. The rigid yoke prevents uneven lateral bending on the head of the camming device that may otherwise cause the device to pull out of a placement. The cable terminals are positioned between the outer cam lobes and on either side of the inner cam lobe. Alternatively, a combination of compression springs and other springs could be used to actuate the cam lobes and remain consistent with the present invention. Likewise, any number of cam lobes may be used and remain consistent with the teachings of the present invention. Also, while embodiments of the present invention are described in the context of an improved dual stem active camming device, it will be appreciated that the teachings of the present invention are applicable to other applications as well. For example, the teachings of the present invention could also be applied to a single or triple stem active camming device.

Figure 1:
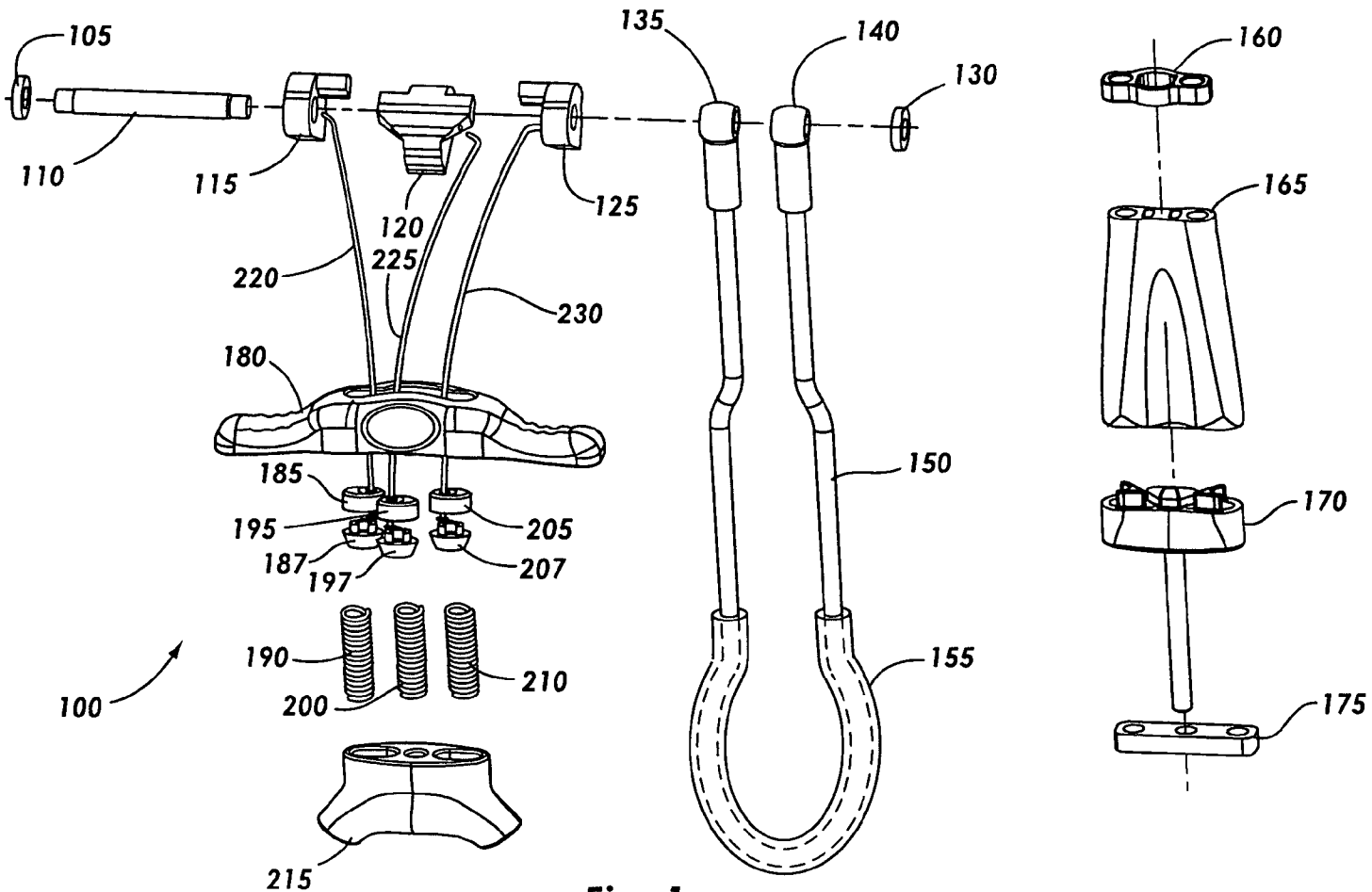
FIG. 1 illustrates an exploded view of one embodiment of an improved dual stem, three cam lobe active camming device in accordance with the present invention.

Reference is initially made to FIG. 1, which illustrates an exploded view of one embodiment of an improved dual stem, three cam lobe active camming device in accordance with the present invention, designated generally at 100. The device 100 is exploded in a multi-part manner to properly illustrate the interconnections between all of the components. The device 100 generally includes three cam lobes 115, 120, 125 disposed on an axle 110. The cam lobes 115,

120, 125 and axle 110 are coupled to two cable terminals 135, 140 via two washers 105, 130. When assembled, the cable terminals 135, 140 are disposed between the outer cam lobes 115, 125 and on either side of the middle cam lobe 120. A cable terminal or terminal is defined broadly to include any means for coupling the axle and or the cam lobes to the stem portion of the device. The device further includes a connection system and a retraction system. The connection system provides support and protection for the entire device 100 and allows a user to connect the device to a rope via a clip-in point. The retraction system biases the cam lobes 115, 120, 125 in an open position but allows them to be retracted so that the device 100 can be inserted into a crevice.

The retraction system is illustrated on the left portion of the FIG. 1. The retraction system includes three trigger wires 220, 225, 230 which are coupled to the cam lobes 115, 120, 125 respectively. The trigger wires 220, 225, 230 comprise a stiff wire. Alternatively, a stiff wire could be swaged with a flexible steel wire in order to provide the same functionality. The trigger wires 220, 225, 230 are routed through at least one opening in a trigger 180. The illustrated trigger 180 includes a single opening for the trigger wires 220, 225, 230 to be routed through. The trigger 180 comprises a rigid plastic material. The trigger wires 220, 225, 230 are then individually coupled to a male and female pusher set 185, 187, 195, 197, 205, 207 respectively. The coupling between the trigger wires 220, 225, 230 and the male and female pusher sets 185, 187, 195, 197, 205, 207 is described in more detail with respect to FIGS. 1A and 1B.

Disposed below the pusher sets are three springs 190, 200, 210. When the trigger 180 is retracted, it forces the pushers sets 185, 187, 195, 197, 205, 207 and consequently the trigger wires 220, 225, 230 onto the springs 190, 200, 210. Therefore, the cam lobes 115, 120, 125 are biased into an extended position because the springs 190, 200, 210 bias the pusher sets 185, 187, 195, 197, 205, 207 and the trigger wires 220, 225, 230. Alternatively, the compression springs 190, 200, 210 and the trigger wires 220, 225, 230 could be single units. Meaning that each compression spring is wound out of the same wire as the respective trigger wire. This alternative arrangement would eliminate the need to couple the trigger wires and the compressions springs and possibly allow them to be replaceable. The retraction system will be further explained with reference to FIGS. 2-4.

The connection system is illustrated throughout FIG. 1. The connection system both supports the device 100 and protects the components from undesired effects. The connection system includes a cable 150 that is attached at either end to the cable terminals 135, 140. The cable 150 is bent in the manner shown thereby forming a dual-stem. A first protective sleeve 155 and a second protection sleeve 215 are positioned over the lower portion of the cable 150 to enable the formation of a clip-in loop. A spring stopper 175 is positioned over the cable 150 above the second protective sleeve 215 such that the middle hole on the spring stopper 175 remains open. Springs 190, 210, pusher sets 185, 187, 205, 207 and trigger 180 are fitted over the two ends of the cable. Upper yoke 170 is also fitted over the cable 150. A lower member of the upper yoke 170 is extended through the trigger 180. Pusher set 195, 197 and spring 200 are likewise fitted over the lower member of the upper yoke 170. The lower member of the upper yoke 170 is coupled within the middle hole of the spring stopper 175. The lower member of the upper yoke 170 may be fabricated as part of the upper yoke 170 or as a separate piece, which is coupled to the upper yoke 170 during assembly. A stem tube 165 is positioned over the cable 150 and above the upper yoke 170. The stem tube 165 comprises a stiff plastic material to protect the trigger wires during operation. The stem tube 165 can also be considered to comprise at least one compliant spring to allow for additional flexibility and resistance to over bending. A compliant spring is broadly defined to include the spring like resistance provided by a flexible material returning to its original shape. In addition, a compliant spring includes a cavity on a member that allows for additional flexibility and spring like characteristics. Alternatively, the stem tube 165 could be further supported and protected from damage with a plurality of metal spacers positioned between the compliant springs or a single internal spring that conforms to the internal shape of the stem tube 165. Likewise, the stem tube 165 may be a single unit or multiple units to allow for additional flexibility characteristics. A lower yoke 160 is positioned over the cable 150. The lower yoke 160 further includes three holes, the outer ones of which are fitted over the cable 150. The cable 150 is then coupled to the cable terminals 135, 140. A plurality of trigger wires 220, 225, 230 are coupled to the cam lobes 115, 120, 125 respectively and extended through a large central hole in the lower yoke 160, the internal holes in the stem tube 165, a central hole in the upper yoke 170, the opening in the trigger 180, and coupled to the pusher sets 185, 187, 195, 197, 205, 207. The connection system will be further explained with reference to FIGS. 2-4.

Figure 1A:
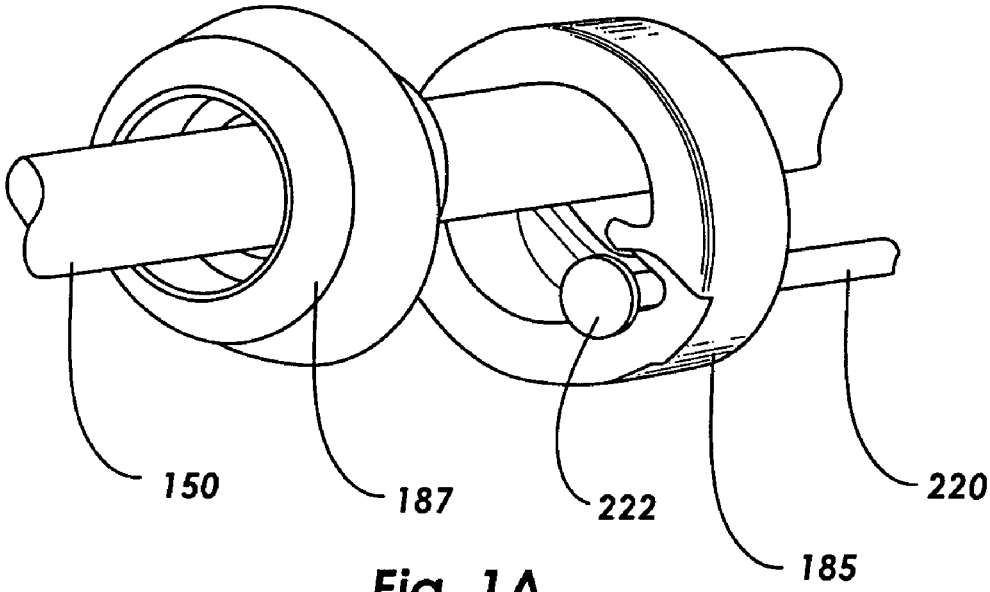
FIGS. 1A and 1B illustrate a detailed perspective view of the pusher set assembly illustrated in FIG. 1.
Figure 1B:
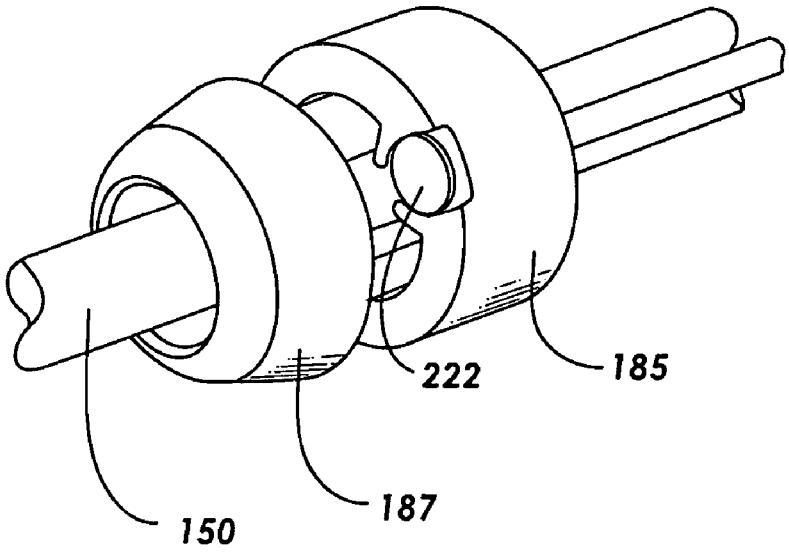

Reference is next made to FIGS. 1A and 1B, which illustrate a detailed perspective view of a pusher set assembly illustrated in FIG. 1. Each pusher set includes a male portion 187 and a female portion 185. Both the male and female portions of the pusher set are fitted over the cable 150, as shown. As shown in FIG. 1A, the female portion 185 includes an opening that is designed to be larger than the cable 150. In addition, the trigger wire 220 includes a head portion 222, as illustrated. The head portion 222 is an expanded portion of the trigger wire 220 including but not limited to a button head, L-bend, solder blob, swage, etc. The opening in the female portion 185 is configured to allow the head portion 222 of the trigger wire 220 to be routed through the opening in addition to the cable 150. This configuration allows the trigger wire 220 to be easily replaceable from either side of the female pusher portion 185. Alternative one-way trigger wire replacement configurations could be implemented and remain consistent with the present invention.

The process for coupling the trigger wire 220 to the pusher sets 185, 187, includes multiple steps. The male and female pusher portions 187, 185 are disposed on the cable 150 between the springs 190 and the trigger 180. The head portion 222 of the trigger wire 220 is routed through the opening in the female pusher portion 185. The head portion 222 is then slotted into a slot or groove on the female pusher portion 185 such that the trigger wire does not interfere with the cable and vice versa. The male and female pusher portions 187, 185 are properly oriented to interlock with one another. The male and female pusher portions 187, 185 are rotationally keyed to require a specific rotational orientation with respect to one another. The male and female pusher portions 187, 185 are then pushed together. In operation, the spring 190 (seen in FIG. 1) biases against the male pusher portion 187 to maintain the coupling between the male and female pusher portions 187, 185. It should also be noted that the male pusher portion 187 includes a counterbore or recessed region to allow the spring 200 to partially enter into the male pusher portion 187. Although described with respect to a single male and female pusher set 187, 185, it will be appreciated that this discussion is applicable to all three male and female pusher sets 185, 187, 195, 197, 205, 207. The middle pusher set 195, 197 will be fitted over a portion of the upper yoke 170 rather than the cable 150.

Figure 2:
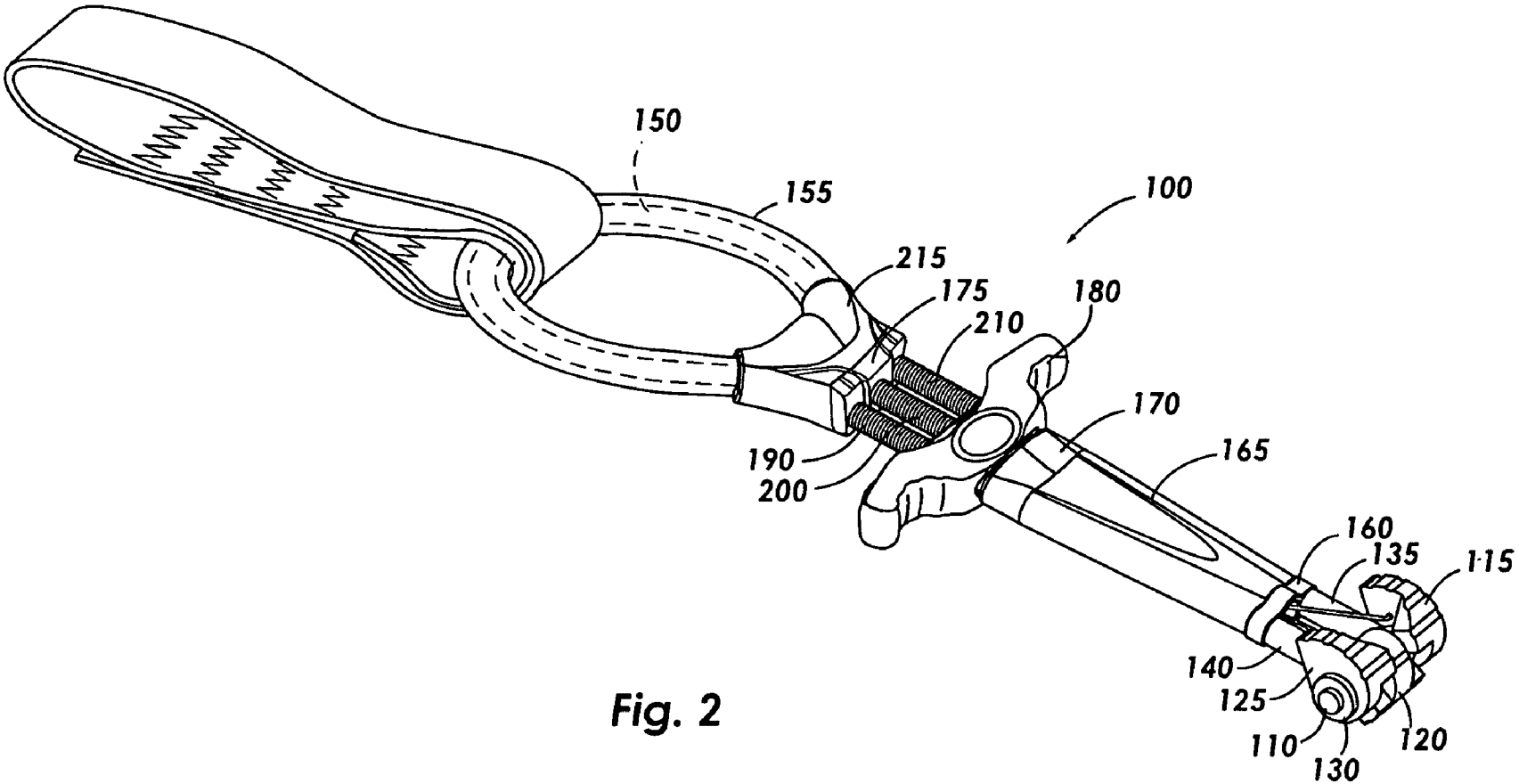
FIG. 2 illustrates a perspective view of the dual stem active camming device illustrated in FIG. 1.

Reference is next made to FIG. 2, which illustrates a perspective view of the assembled dual stem active camming device illustrated in FIG. 1, designated generally at 100. As illustrated, the cable 150, first protective sleeve 155, and second protective sleeve 215 form a convenient clip-in loop on the lower portion of the device 100. A large clip-in-loop is convenient because it allows for easy connection. In addition, the clip-in-loop is used during the process of retracting the cam lobes 115, 120, 125. For example, a user may place their thumb on the second protective sleeve 215 while retracting the trigger 180 with their fingers or alternatively a user may place the palm of their hand against the outermost portion of the clip-in-loop while retracting the trigger 180 with their fingers. In either retraction scenario, the clip-in-loop is used to oppose the retraction force exerted on the trigger 180. A sling is also looped around the clip-in-loop to provide an additional clip in location. It will be appreciated that the sling is doubled over in a particular manner to ensure that the sling is not torn by the cable 150.

It will also be appreciated that the trigger 180 is shaped in a manner to conceal and protect the pusher sets 185, 187, 195, 197, 205, 207 (not visible in FIG. 2) and a portion of the compression springs 190, 200, 210. This design minimizes the possibility of debris interfering with the retraction of the trigger 180 and the pusher sets 185, 187, 195, 197, 205, 207. In addition, the shape of the trigger 180 minimizes the overall length of the device 100. The outer flanges of the trigger 180 are shaped to be lower than the middle portion of the trigger 180 that contacts the pusher sets 185, 187, 195, 197, 205, 207. This design both conceals the pusher sets 185, 187, 195, 197, 205, 207 and minimizes the necessary distance between the clip-in-loop and the trigger 180.

It will also be appreciated that the lower yoke 160 operates to minimize lateral bending and protect the overall integrity of the device 100. Many small camming devices fail in vertical placements when the cable is allowed to laterally bend beyond a particular angle. The lower yokes 160 interconnect the two portions of the cable 150 in a rigid manner to transfer any lateral bending moments onto both cable terminals 135, 140. By transferring the lateral bending forces between the two cable terminals 135, 140, the device is able to withstand additional bending force before it rips out of a placement. In addition, the flexibility of the stem tube 165, allows the cable 150 to bend, thereby transferring the bending force onto the lower yoke 160 where it is distributed between the two cable terminals 135, 140. Therefore, the inclusion of the stem tube 165 and the lower yoke 160 on any dual stem active camming device will result in requiring an even greater force for undesirable lateral bending to occur.

It will also be appreciated that the positioning of the cable terminals 135, 140 between the outer cam lobes 115, 125 and on either side of the inner cam lobe 120 minimizes the possibility of axle bending. Another reason camming devices fail is when the axle that interconnects the cam lobes is allowed to bend. Axles bend around the cam lobes as a result of the force exerted upon them at the point at which the axle is coupled to the cable terminals. Therefore, the distance from any one cam lobe to the nearest cable terminal, along the axle, effectively forms a moment arm. To maximize the force required to bend the axle around the cam lobe, the moment arm distance must be minimized. In the illustrated embodiments of FIGS. 1-4, the moment arm distance is minimized because the cable terminals are located between the cam lobes. Therefore, the maximum moment arm distance is the lateral length of one of the cam lobes.

Figure 3:
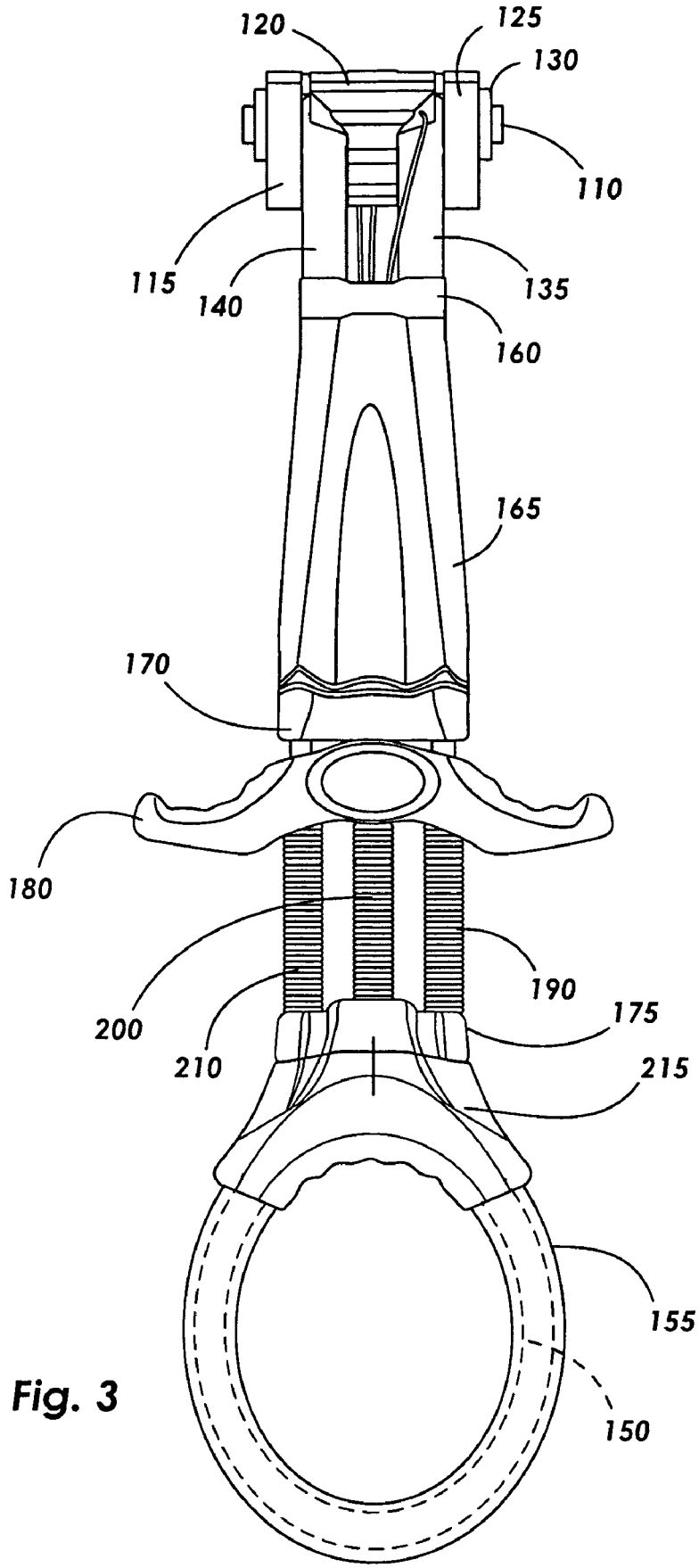
FIG. 3 illustrates a top view of the dual stem active camming device illustrated in FIG. 1.

Reference is next made to FIG. 3, which illustrates a top view of the dual stem active camming device illustrated in FIG. 1, designated generally at 100. The top view illustrates more precisely the shape and curvature of many of the components.

Figure 4:
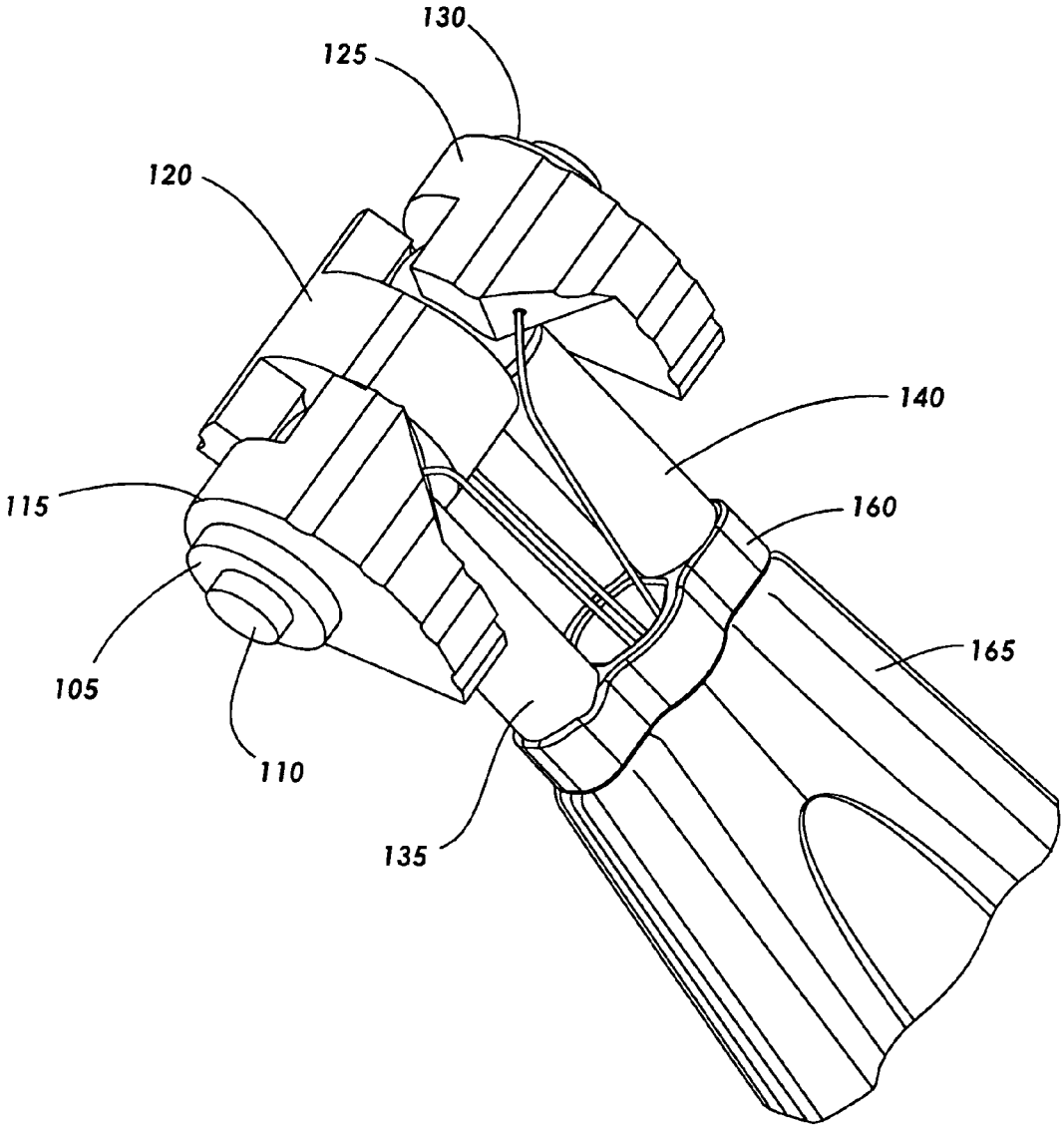
FIG. 4 illustrates a perspective view of the head portion of the dual stem active camming device illustrated in FIG. 1

Reference is next made to FIG. 4, which illustrates a perspective view of the head portion of the dual stem active camming device illustrated in FIG. 1. The head portion of the device 100 specifically includes the cam lobes 115, 120, 125 and the various other components that couple them to the remainder of the device 100. The cam lobes 115, 120, 125 are rotatably positioned on the axle 110. The cam lobes 115, 120, 125 each include a hole that allows them to be slid over the axle in the manner shown 110. In addition, the cable terminals 135, 140 are coupled to the axle 110 between the outer cam lobes 115, 125 and on either side of the middle cam lobe 120. The cable terminals 135, 140 include a hole to allow them to be slid over the axle 110. On either end of the axle 110 is a washer 105, 130 that prevents the outer cam lobes 115, 125 from sliding off the axle 110. It will be appreciated that numerous other systems could be used for retaining the cam lobes 115, 120, 125 on the axle 110 without interfering with their rotation. The cable terminals 135, 140 are likewise coupled to the cable 150, which forms the dual stem. The lower yoke 160 and the stem tube 165 are fitted over the cable 150 in the manner shown. Trigger wires are individually coupled to each of the cam lobes 115, 120, 125 and routed through the large central hole in the lower yoke 160 and the internal holes in the stem tube 165 as shown.

Figure 5:
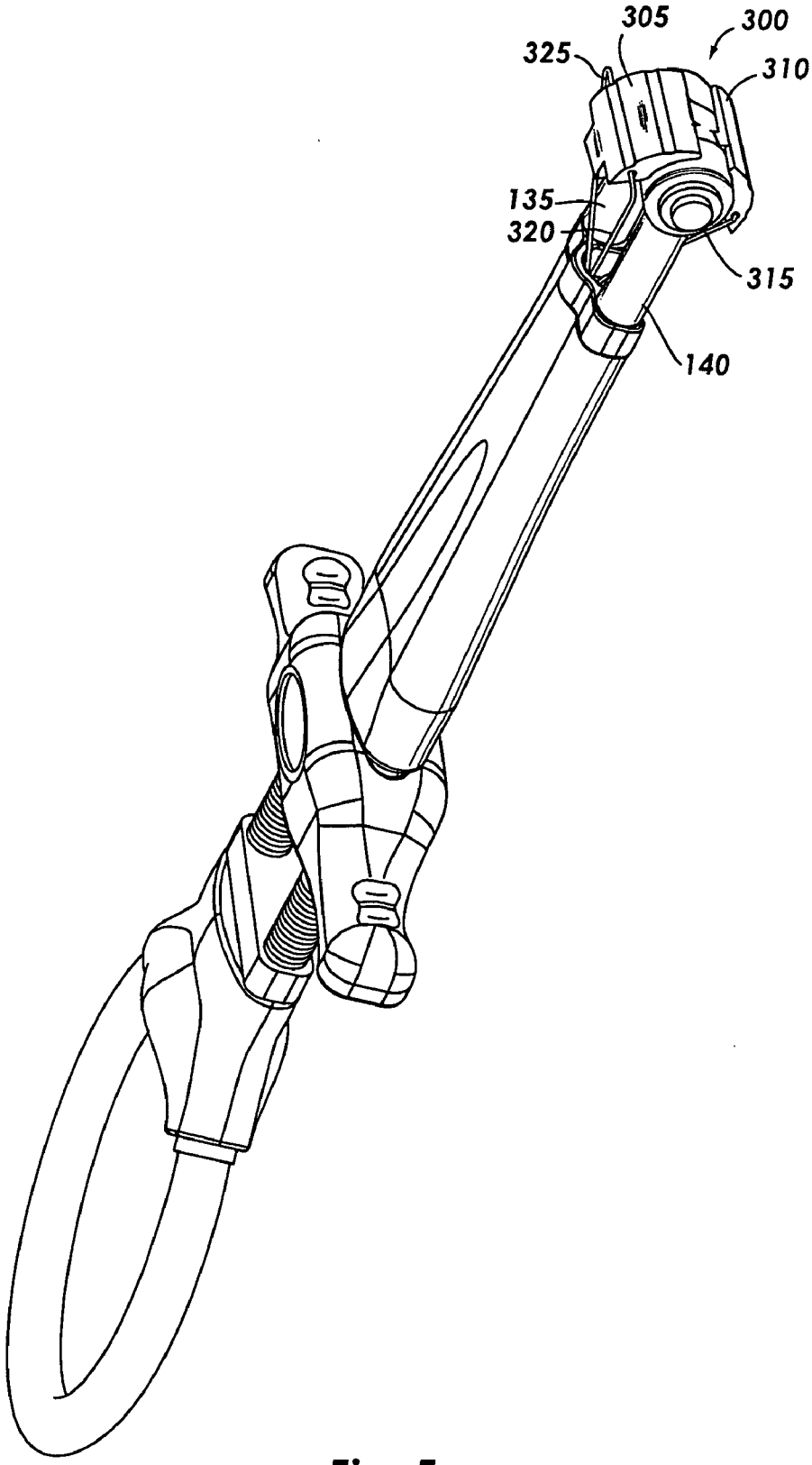
FIG. 5 illustrates a perspective view of an alternative embodiment of a dual stem active camming device according to the present invention wherein the head portion includes two cam lobes.

Reference is next made to FIG. 5, which illustrates a perspective view of an alternative embodiment of a dual stem active camming device according to the present invention wherein the head portion includes two opposing cam lobes. The alternative head portion is designated generally at 300. Two cam lobe devices are generally useful for fitting into small holes or slots that would not otherwise accommodate a three or four cam lobe device. In this embodiment, only two cam lobes 305, 310 are coupled to the axle of the device 100. The cable terminals 135, 140 are positioned on the outside of the two cam lobes 305, 310. In addition, trigger wires 315, 320, 325 are coupled to the two cam lobes and to the pushers (not visible in this view). Since there are only two cam lobes instead of three, only two springs are necessary to independently control the cam lobes 305, 310. The two trigger wires 320, 325 attached to the first cam lobe 305 will be coupled to one pusher while the two trigger wires 315, 330 coupled to the second cam lobe 310 will be coupled to another pusher. In this embodiment, the two necessary springs and pushers will be positioned over the cable. Alternatively, for manufacturing simplicity, a third spring and pusher may remain on the device but not perform any function. In addition, it should be noted that an alternative embodiment in which the cam lobes are disposed on the outside of the cable terminals has been contemplated and is consistent with the teachings of the present invention.

Figure 6:
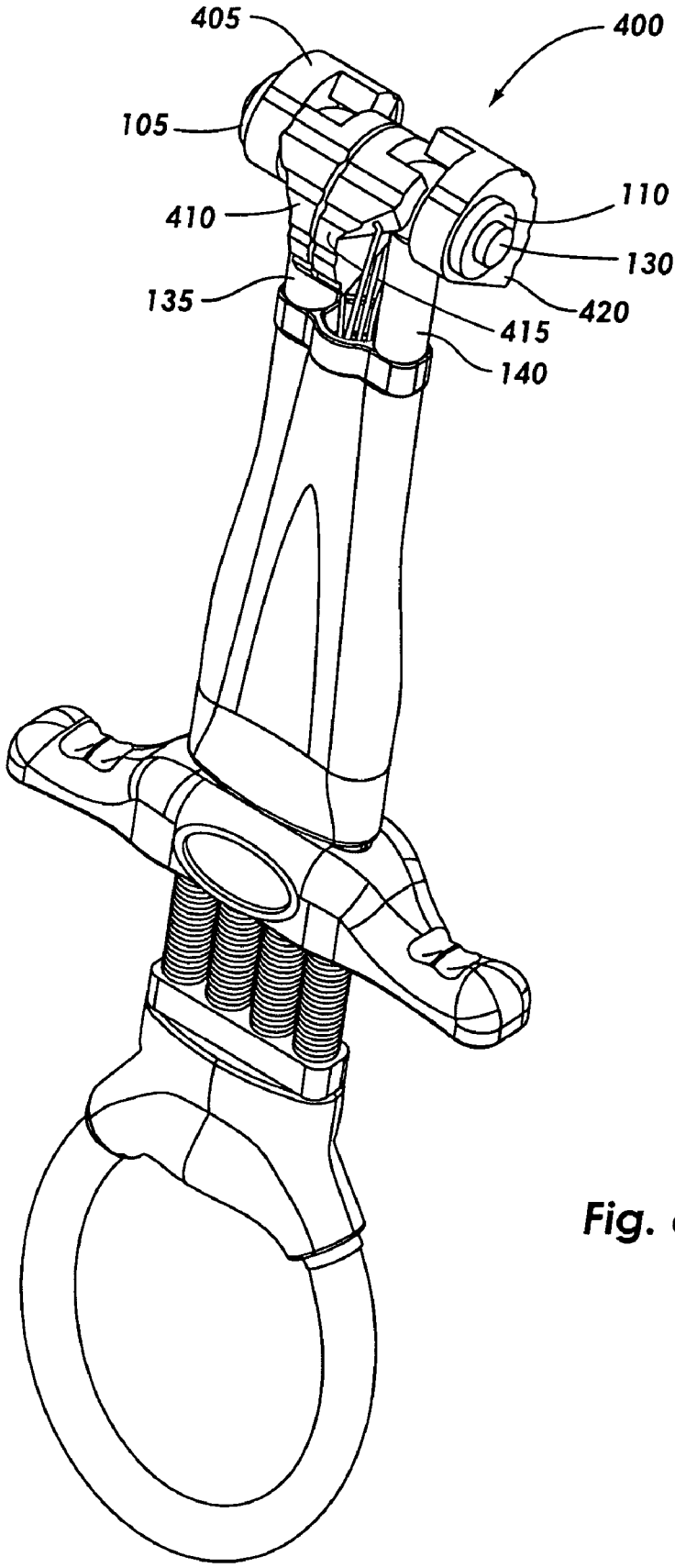
FIG. 6 illustrates a perspective view of another alternative embodiment of a dual stem active camming device according to the present invention, wherein the head portion includes four cam lobes.

Reference is next made to FIG. 6, which illustrates a perspective view of another alternative embodiment of a dual stem active camming device according to the present invention, wherein the head portion includes four cam lobes. Four cam lobe devices provide additional stability when fitted into small crevices because they often facilitate at least four connection points between the device and the camming surface. The alternative head portion is designated generally at 400. In this embodiment, four cam lobes 405, 410, 415, and 420 are coupled to the axle of the device 100. The cable terminals 135, 140 are positioned between the outer two cam lobes 405, 420 and on either side of the two inner cam lobes 410, 415. As described above with reference to FIG. 4, the positioning of the cable terminals 135, 140 is very important for minimizing the possibility of axle bend. Since there are four cam lobes 405, 410, 415, 420, four springs are necessary to independently control all four cam lobes 405, 410, 415, 420. Alternatively, the two middle cam lobes 410, 415 can be coupled to the same spring thereby only requiring three springs. This may be necessary for manufacturing simplicity and cost savings. Other cam lobe to spring coupling configurations may be practiced and remain consistent with the teachings of the present invention.

While this invention has been described with reference to certain specific embodiments and examples, it will be recognized by those skilled in the art that many variations are possible without departing from the scope and spirit of this invention. For example, the teachings of one embodiment may be combined with the teachings of another and remain consistent with the scope and spirit of this invention. The invention, as defined by the claims, is intended to cover all changes and modifications of the invention which do not depart from the spirit of the invention. The words "including" and "having," as used in the specification, including the claims, shall have the same meaning as the word "comprising."

What is claimed is:

1. An active camming device comprising:

a plurality of opposing cam lobes coupled to at least one terminal;

a retraction system coupled to the plurality of opposing cam lobes, wherein the retraction system includes a plurality of springs independently coupled to the plurality of opposing cam lobes such that each of the opposing cam lobes can be independently rotated, and wherein at least one of the plurality of springs is a compression spring; and a connection system attached to the at least one terminal.

2. The active camming device of claim 1, wherein the at least one terminal includes two terminals and the active camming device is a dual stem active camming device.

3. The active camming device of claim 1, wherein the at least one terminal includes two terminals which are disposed between two of the plurality of opposing cam lobes and on either side of a different one of the plurality of opposing cam lobes.

4. The active camming device of claim 1, wherein the plurality of opposing cam lobes includes two opposing cam lobes and wherein the at least one terminal includes two terminals, and wherein the two opposing cam lobes are disposed between the two terminals.

5. The active camming device of claim 1, wherein the plurality of opposing cam lobes includes two outer cam lobes and a middle cam lobe, and wherein the at least one terminal includes two terminals which are positioned between the two outer cam lobes and on either side of the middle cam lobe.

6. The active camming device of claim 1, wherein the plurality of opposing cam lobes includes two outer cam lobes and two inner cam lobes, and wherein the at least one terminal includes two terminals that are positioned between the two outer cam lobes and on either side of the two middle cam lobes.

7. The active camming device of claim 1, wherein the at least one compression spring is disposed adjacent to a trigger portion of the retraction system.

8. The active camming device of claim 1, wherein all of the plurality of springs are compression springs.

9. The active camming device of claim 1, wherein the plurality of springs include at least one torsion spring.

10. The active camming device of claim 1, wherein the plurality of springs include at least one extension spring.

11. The active camming device of claim 1, wherein the retraction system further includes a trigger disposed adjacent to the at least one compression spring such that when the trigger is retracted the at least one compression springs are compressed.

12. The active camming device of claim 11, wherein the retraction system further includes at least one pusher disposed between the trigger and the at least one compression spring.

13. The active camming device of claim 12, wherein the pusher further includes a male portion and a female portion that interlock with one another to releasably secure the trigger wire between the trigger and the at least one compression spring.

14. The active camming device of claim 13, wherein the interlockable male and female portions of the pusher allow the trigger wires to be replaceable.

15. The active camming device of claim 1, wherein the retraction system further includes a plurality of trigger wires, wherein at least one trigger wire is coupled between one of the plurality of opposing cam lobes and the at least one compression spring.

16. The active camming device of claim 15, wherein the plurality of trigger wires comprise a flexible cable.

17. The active camming device of claim 15, wherein the at least one compression spring and at least one of the plurality of trigger wires is made out of the same piece of material.

18. The active camming device of claim 1, wherein the retraction system includes three compression springs, and wherein the plurality of opposing cam lobes includes three cam lobes independently coupled to the three compression springs, and wherein two of the compression springs are fitted over a dual stem and adjacent to a trigger.

19. The active camming device of claim 1, wherein the connection system includes a single cable, and wherein the at least one terminal includes two terminals coupled to either end of the single cable thereby forming a dual stem.

20. The active camming device of claim 1, wherein the connection system further includes a stem tube with at least one internal cavities coupled to a dual stem.

21. The active camming device of claim 20, wherein the stem tube is flexible and comprises at least one compliant spring.

22. The active camming device of claim 20, wherein the stem tube further includes at least one metal member to provide additional support and protection.

23. The active camming device of claim 1, wherein the connection system further includes a rigid yoke coupled to a dual stem and disposed adjacent to the at least one terminal.

24. An active camming device comprising:

at least three opposing cam lobes coupled to two terminals, wherein two of the opposing cam lobes are disposed on the outer edges of the two terminals and the remaining cam lobes are disposed between the two terminals;

a retraction system coupled to the at least three opposing cam lobes, wherein the retraction system includes at least one compression spring independently coupled to one of the at least three opposing cam lobes; and a connection system attached to the two terminals.

25. The active camming device of claim 24, wherein the retraction system includes at least three compression springs independently coupled to each of the at least three opposing cam lobes.

26. The active camming device of claim 24, wherein the at least one compression spring is disposed adjacent to a trigger portion of the retraction system.

27. The active camming device of claim 24, wherein the retraction system includes at least one torsion spring.

28. The active camming device of claim 24, wherein the retraction system further includes a trigger disposed adjacent to the at least one compression spring such that when the trigger is retracted the at least one compression springs are compressed.

29. The active camming device of claim 28, wherein the retraction system further includes at least one pusher disposed between the trigger and the at least one compression spring.

30. The active camming device of claim 29, wherein the pusher further includes a male portion and a female portion that interlock with one another to releasably secure the trigger wire between the trigger and the at least one compression spring.

31. The active camming device of claim 30, wherein the interlockable male and female portions of the pusher allow the trigger wires to be replaceable.

32. The active camming device of claim 24, wherein the retraction system further includes a plurality of trigger wires, wherein at least one trigger wire is coupled between a cam lobe and the at least one compression spring.

33. The active camming device of claim 32, wherein the plurality of trigger wires comprise a flexible cable.

34. The active camming device of claim 24, wherein the retraction system includes three compression springs independently coupled to the at least three opposing cam lobes, and wherein two of the compression springs are disposed over the stem and adjacent to a trigger.

35. The active camming device of claim 24, wherein the connection system includes a single cable coupled on either end to the at least two terminals thereby forming a dual stem.

36. The active camming device of claim 24, wherein the connection system further includes a stem tube with multiple internal cavities coupled to a dual stem substantially adjacent to the two terminals.

37. The active camming device of claim 36, wherein the stem tube is flexible and comprises at least one compliant spring.

38. The active camming device of claim 36, wherein the stem tube further includes at least one metal member to provide additional support ant protection.

39. The active camming device of claim 24, wherein the connection system further includes a rigid yoke coupled to a dual stem and disposed adjacent to the two terminals.

40. An active camming device comprising:

a plurality of opposing cam lobes coupled to at least one terminal;

a retraction system coupled to the plurality of opposing cam lobes, wherein the retraction system includes a trigger and at least one compression spring disposed adjacent to the trigger such that the at least one compression spring is compressed by the retraction of the trigger, and wherein the at least one compression spring is independently coupled to at least one of the plurality of cam lobes; and a connection system attached to the at least one terminal.

41. The active camming device of claim 40, wherein the at least one terminal includes two terminals which are disposed between two of the plurality of opposing cam lobes.

42. The active camming device of claim 40, wherein the plurality of opposing cam lobes includes two opposing cam lobes, and wherein the at least one terminal includes two terminals disposed on either side of the two opposing cam lobes.

43. The active camming device of claim 40, wherein the plurality of opposing cam lobes includes two outer cam lobes and a middle cam lobe, and wherein the at least one terminal includes two terminals that are positioned between the two outer cam lobes and on either side of the middle cam lobe.

44. The active camming device of claim 40, wherein the plurality of opposing cam lobes includes two outer cam lobes and two inner cam lobes, and wherein the at least one terminal includes two terminals which are positioned between the two outer cam lobes and on either side of the two middle cam lobes.

45. The active camming device of claim 40, wherein the retraction system includes at least one torsion spring.

46. The active camming device of claim 40, wherein the retraction system further includes a plurality of trigger wires, wherein at least one trigger wire is coupled between one of the plurality of cam lobes and the at least one compression spring.

47. The active camming device of claim 46, wherein the plurality of trigger wires comprises a flexible cable.

48. The active camming device of claim 40, wherein the retraction system further includes at least one pusher disposed between the trigger and the at least one compression spring.

49. The active camming device of claim 48, wherein the pusher further includes a male portion and a female portion that interlock with one another to releasably secure the trigger wire between the trigger and the at least one compression spring.

50. The active camming device of claim 49, wherein the interlockable male and female portions of the pusher allow the trigger wires to be replaceable.

51. The active camming device of claim 40, wherein the retraction system includes three compression springs independently coupled to the plurality of opposing cam lobes, and wherein two of the compression springs are fitted over a dual stem and adjacent to the trigger.

52. The active camming device of claim 40, wherein the connection system includes a single cable, and wherein the at least one terminal includes two terminals coupled to either end of the single cable thereby forming a dual stem.

53. The active camming device of claim 40, wherein the connection system further includes a stem tube with multiple internal cavities coupled to a dual stem.

54. The active camming device of claim 50, wherein the stem tube is flexible and comprises at least one compliant spring.

55. The active camming device of claim 50, wherein the stem tube further includes at least one metal member to provide additional support and protection.

56. The active camming device of claim 40, wherein the connection system further includes a rigid yoke coupled to a dual stem and disposed adjacent to the at least one terminal.

57. A method of protecting the integrity of an active camming device comprising:

providing a dual stem active camming device including:

a plurality of opposing cam lobes coupled to two terminals;

a retraction system coupled to the plurality of opposing cam lobes via a plurality of trigger wires, wherein the retraction system includes a plurality of springs independently coupled to the plurality of opposing cam lobes such that each of the opposing cam lobes can be independently rotated, and wherein at least one of the plurality of springs is a compression spring; and coupling a rigid yoke to the dual stem active camming device adjacent to the two terminals thereby minimizing the possibility of uneven lateral bending on the dual stem active camming device near the two terminals when a lateral force is applied to the dual stem active camming device.

58. A method of protecting the integrity of an active camming device comprising:

providing a dual stem active camming device including:

a plurality of opposing cam lobes coupled to two terminals;

a retraction system coupled to the plurality of opposing cam lobes via a plurality of trigger wires, wherein the retraction system includes a plurality of springs independently coupled to the plurality of opposing cam lobes such that each of the opposing cam lobes can be independently rotated, and wherein at least one of the plurality of springs is a compression spring;

a connection system attached to the two terminals; and coupling a stem tube to the dual stem active camming device between a trigger and the two terminals, wherein the stem tube includes at least one internal cavity and at least one compliant spring, wherein the trigger wires are routed though the at least one internal cavity.

59. The method of claim 58, wherein the stem tube further includes at least one metal member to provide additional protection and support.

* * * * *